US008727952B1

(12) United States Patent
Carle

(10) Patent No.: US 8,727,952 B1
(45) Date of Patent: May 20, 2014

(54) EXERCISE APPARATUS

(76) Inventor: John T. Carle, McCleary, WA (US)

( * ) Notice: Subject to any disclaimer, the term of this patent is extended or adjusted under 35 U.S.C. 154(b) by 310 days.

(21) Appl. No.: 13/385,102

(22) Filed: Feb. 2, 2012

Related U.S. Application Data

(60) Provisional application No. 61/462,494, filed on Feb. 3, 2011.

(51) Int. Cl.
*A63B 21/00* (2006.01)

(52) U.S. Cl.
USPC ..... 482/99; 482/102; 482/103; 482/98

(58) Field of Classification Search
USPC ..... 482/98, 99, 106, 102
See application file for complete search history.

(56) References Cited

U.S. PATENT DOCUMENTS 4,603,855 A 8/1986 Sebelle
5,135,453 A 8/1992 Sollenberger
6,447,430 B1 * 9/2002 Webb et al. ..... 482/98
6,527,683 B2 3/2003 Tolles
6,685,600 B1 2/2004 Ullman
7,766,803 B2 * 8/2010 Carter ..... 482/102
8,435,163 B2 * 5/2013 Uygan ..... 482/102
2002/0111254 A1 8/2002 O'Hearn
2004/0072659 A1 * 4/2004 Alessandri et al. ..... 482/99
2007/0042878 A1 * 2/2007 Lundquist et al. ..... 482/99
2007/0049471 A1 * 3/2007 Huang ..... 482/99
2009/0143202 A1 * 6/2009 Carter ..... 482/99

* cited by examiner

*Primary Examiner* — Jerome W Donnelly

(57) ABSTRACT

An exercise apparatus for performing a wide range of full body motions against cabled weight resistance by providing user-selectable arrangements of pulleys. A pulley carriage carries one or more carriage pulleys and is slidable on a vertical stanchion. Each pulley arrangement comprises the combination of a user-selectable, vertical height for the carriage pulleys together with user-selectable locations on the frame of the apparatus for attachment of a pair of hand pulleys, whereby the amount of slack in cables routed through the pulleys is adjustable by varying the height of the carriage pulleys.

30 Claims, 15 Drawing Sheets

EXERCISE APPARATUS

CROSS-REFERENCE TO RELATED PATENT APPLICATIONS

This application claims the benefit of U.S. provisional application No. 61/462,494 for the same invention, filed on Feb. 3, 2011, the disclosure of which is incorporated herein.

STATEMENT REGARDING FEDERALLY APPROVED RESEARCH OR DEVELOPMENT

None.

BACKGROUND OF THE INVENTION

1. Field of the Invention

This invention relates generally to apparatus for performing bodily exercises, and more particularly to an exercise machine for performing a wide range of full body motions against cabled weight resistance by providing user-selectable arrangements of pulleys. A pulley carriage carries one or more carriage pulleys and is slidable on a vertical stanchion. Each pulley arrangement comprises the combination of a user-selectable, vertical height for the carriage pulley(s) together with user-selectable locations on the frame of the apparatus for attachment of a pair of hand pulleys. Adjustment of the vertical height of the carriage pulley(s) permits the user to increase or decrease the amount of slack in the cables attached to the hand pulleys to an amount that is optimal for each kind of exercise.

2. Background Art

Various machines for strength training are well known in the art. These include machines that utilize a weight stack and pulley system mounted to a frame to provide resistance to an exercise movement. Such machines provide either a single, centrally-disposed weight stack or a pair of laterally spaced-apart weight stacks. As is the case with the instant invention, one or more of the pulleys may be fixed to the frame, one or more of the pulleys may be attachable to the frame at any of multiple locations on the frame, and one or more of the pulleys may move in response to movements of a cable threaded through the pulley(s). U.S. Pat. No. 6,527,683, issued to Tolles, for instance, disclosed an exercise machine that incorporated a dual adjustable pulley system that included first and second movable pulleys. Unlike the movable, carriage pulleys of the instant invention that are height adjustable on a vertical stanchion by the user for optimal cable slack, however, the movable pulleys disclosed by Tolles were disposed above, and attached to, a weight stack, not slidably mounted to a vertical stanchion, and not height-adjustable by the user for optimal cable slack.

In order to permit a wide variety of pulley arrangements, the instant invention provides a pair of laterally spaced-apart swivel pulleys, mounted to an upper portion of the frame, through which left and right cables pass; the left and right cables thence pass around left and right hand pulleys, and from there connect to left and right hand grips, respectively. The swivel pulleys permit the cables to be angled variously outward from an upper, rear portion of the frame, depending on the user-selected positions for attaching the hand pulleys to the frame. Swivel pulleys have been incorporated into exercise machines prior to the instant invention. U.S. Pat. No. 5,135,453, issued to Sollenberger, for instance, disclosed an exercise machine having a pair of laterally spaced-apart swivel pulleys from which portions of cables extend angularly outward with respect to the machine frame. Unlike the instant invention, however, Sollenberger's cables did not extend to left and right hand pulleys, but instead extended directly to a pair of hand grips.

U.S. Pat. No. 6,685,600 B, issued to Ullman, disclosed an accessory device that was attachable to a conventional exercise machine and provided a user an infinite number of angles for use in exercising muscles. Ullman's device included top and bottom braces attachable to top and bottom portions of an exercise machine, respectively, and left and right, semicircular beams pivotally attachable to the top and bottom braces and lockable in place by pairs of nuts and bolts. Inside edges of each of the beams comprised a slide rail with a plurality of spaced-apart holes. Left and right track pulleys were selectably attachable to the left and right beams at any of the holes therein. Left and right weight stacks and left and right cables were provided. Each cable extended from a weight stack up and over a guide pulley attached to the top brace, thence around a track pulley and thence downward to a hand grip. By rotating the beams about a vertical axis, and by selecting the positions of the track pulleys along the beams, a wide variety of exercises could be performed by pulling on the handgrips. Unlike the instant invention, however, Ullman's device included no carriage pulleys slidable on a vertical stanchion and no means for a user to adjust the slack in the left and right cables. Moreover, unlike Ullman's device, the instant invention provides indicia labels for each selectable position of the carriage pulleys on the vertical stanchion, and for each selectable position of the hand pulleys on the frame. Accordingly, once optimal positions have been determined by the user for each kind of exercise, those indicia can be used to quickly and easily reconfigure the pulley arrangements for a particular exercise to those indicia-labeled locations on the stanchion and on the frame that have been found to be optimal for that exercise—including the optimal amount of cable slack.

SUMMARY OF THE INVENTION

Thus, there remains a need for an exercise apparatus that permits rapid and easy conversion between pulley arrangements, each pulley arrangement being chosen as optimal for any one of a wide range of bodily exercises. There further remains a need for such an exercise apparatus that permits easy adjustment of cable slack to that which is optimal for a particular user who desires to perform a particular kind of exercise. The instant invention provides these and other features and advantages that will become apparent from the detailed description and drawings set forth below.

To achieve these features and advantages, the invention in a first embodiment provides a frame having a plurality of spaced-apart openings; a vertical stanchion attached to the frame and having a plurality of vertically spaced-apart holes; a pulley carriage assembly slidably mounted for vertical travel along the stanchion, which carriage assembly includes a pulley carriage and carriage pin, said carriage being manually adjustable to a desired height and then fixed at said desired height by inserting the carriage pin into a selected one of the openings of the stanchion; left and right weight stack assemblies attached to the frame and disposed on opposite sides of the stanchion; left and right weight pulleys attached to the left and right weight stack assemblies, respectively; left and right swivel pulleys mounted to upper, left and right, rear portions of the frame, respectively; left and right hand pulleys, each hand pulley being attachable to any one of openings in the frame; left and right pairs of horizontally spaced-apart guide pulleys mounted on upper, left and right, rear portions of the frame, respectively; a left cable; a right cable; and left and right hand grips. The left cable extends from a first end to an opposite, second end. The first end of the left cable is attached to an upper, rear, left portion of the frame, from whence the cable extends around the underside of the left weight pulley, thence up to and over the left pair of guide pulleys, thence down to and around the underside of the left carriage pulley, thence up to and over the left swivel pulley, thence to and around the left hand pulley from whence the second end extends downward to the left hand grip. The same is true for the right cable if we but substitute "right" for "left." In a preferred embodiment, the openings in the stanchion are labeled with indicia—the numerals 1 through 35, for instance; and the openings in the frame are labeled with indicia—the letters A through Z for the left side of the frame and, again, the letters A through Z for the right half of the frame, for instance. By adjusting the height of the carriage assembly, a user can create an optimal amount of slack in the left and right cables for performing a particular exercise.

In a second, alternative embodiment, the invention provides a frame that includes left and right, laterally spaced apart, upright, symmetrically and oppositely-disposed, rectangular loops with rounded corners. The loops comprise tubular material of circular cross-section, preferably steel, and are oriented with respect to one another at an angle θ of 70° to 130°, and preferably at 90°. Each loop includes a horizontal top member, a horizontal bottom member, an outer vertical member, and an inner vertical member, which members, joined by the four rounded corners, form a rectangular loop. The frame further includes a horizontal, rear, top cross bar that joins the upper, inner corners of the left and right loops to each other; a horizontal, front, top cross bar that joins the upper, outer corners of the left and right loops to each other; and a horizontal, bottom cross bar that joins the lower, inner corners of the left and right loops to each other. The frame further includes horizontal, upper and lower weight stack mounting plates attached to the top and bottom members of each loop, respectively. A vertical stanchion is provided for each loop. Each stanchion has a plurality of vertically spaced-apart openings and has a lower end attached to a lower weight stack mounting plate and an upper end attached to an upper weight stack mounting plate. A pulley carriage is provided for each stanchion, mounted for vertical travel thereon. Each pulley carriage carries a pulley disposed for rotation about a horizontal axis. A carriage pin is provided for each pulley carriage, which pin is insertable into any one of the openings in the stanchion in order to temporarily fix the position of the pulley carriage on the stanchion. Left and right weight stack assemblies are provided for the left and right loops, respectively, which assemblies are attached to, and extend between, the lower and upper weight stack mounting plates and are substantially identical to those of the first embodiment. Left and right swivel pulleys are mounted to upper, left and right portions of the frame, respectively. Left and right upper pulley means together with guide pulleys are attached to left and right, upper weight stack mounting plates for routing cable from the left and right weight stacks to the left and right stanchions, respectively. Each of the loops has a plurality of spaced-apart openings. Left and right hand pulleys are pivotally suspended from left and right, slotted collar assemblies that are slidably mounted on the left and right loops, respectively, and can be located adjacent to any one of the user-selectable openings in the respective loops. Each collar assembly includes a collar that has an interior diameter that is slightly larger than the external diameter of the tubing of the loop to which it is attached and a spring-loaded pop pin inserted radially through the collar and insertable into any one of said openings of a loop. A guide rail extends radially outward from a peripheral surface of each loop and extends substantially the full length of each loop. A longitudinal slotted cut out in each collar is dimensioned to receive the guide rail, whereby each collar is prevented from rotating about the tubing of the loop to which it is mounted. The slotted openings in each collar also permit sliding the collars past the portions of the loops to which the upper and lower weight stack mounting plates are attached. Accordingly, the invention permits a maximal range of adjustment of the positions of the hand pulleys, both quickly and easily. The second embodiment of the invention further includes left and right cables, each of which extends from a first end to an opposite second end. The route of each cable is as follows. A first end of each cable is attached to a weight stack post, thence rises up and over upper pulley means, thence down to, and partially around, a carriage pulley, thence up and over a swivel pulley, thence down to, and partially around, a hand pulley (attached to a slotted collar assembly), from whence a second, opposite end of the cable is attached to a hand grip.

A third embodiment of the invention, intended principally for physically impaired and wheelchair-bound persons, retains most of the components of the second embodiment but reduces the height of the loops, attaches weight stack pulleys instead of turnbuckles to the weight stack posts, provides a second pair of hand grips, and routes the cables through the apparatus differently. The pulley carriages, slotted collar assemblies, and both sets of hand grips can all be grasped and manipulated by a person seated in a wheelchair that is disposed adjacent to the weight stacks.

DETAILED DESCRIPTION OF THE INVENTION

Figure 1:
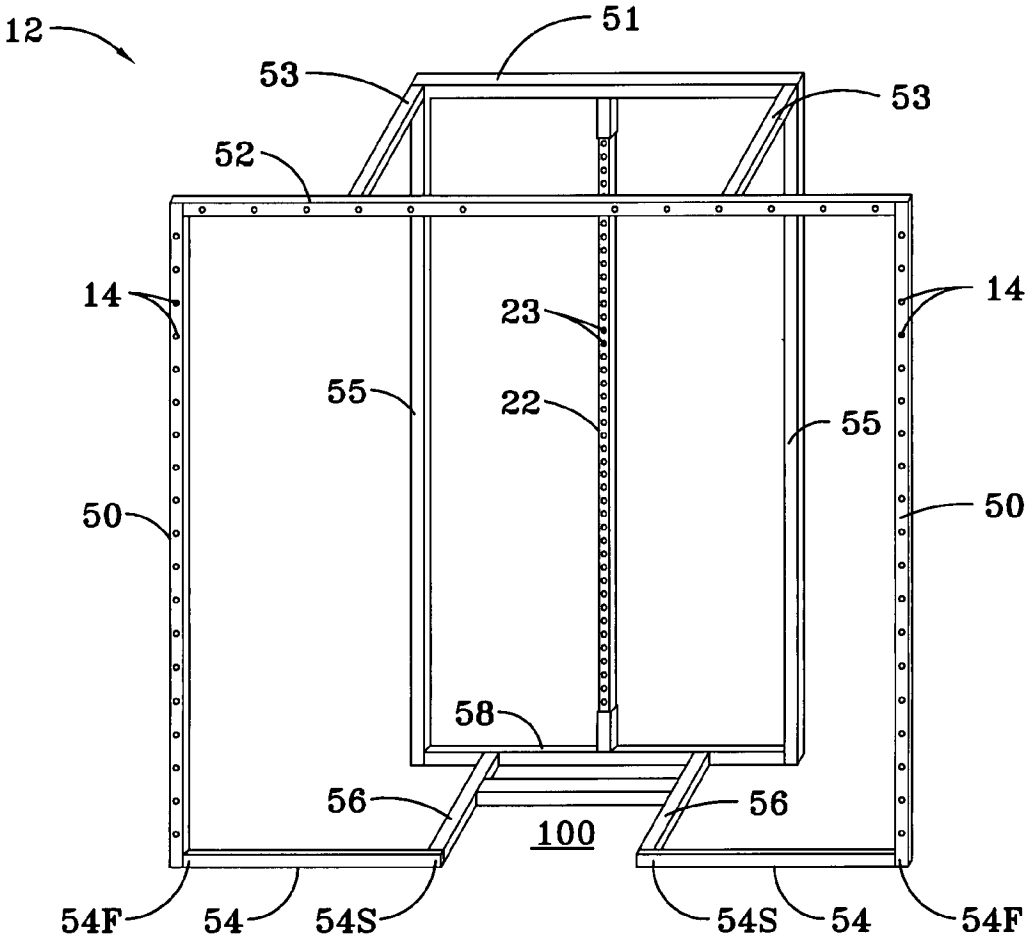
FIG. 1 is a front, perspective view of the frame of the apparatus.
Figure 2:
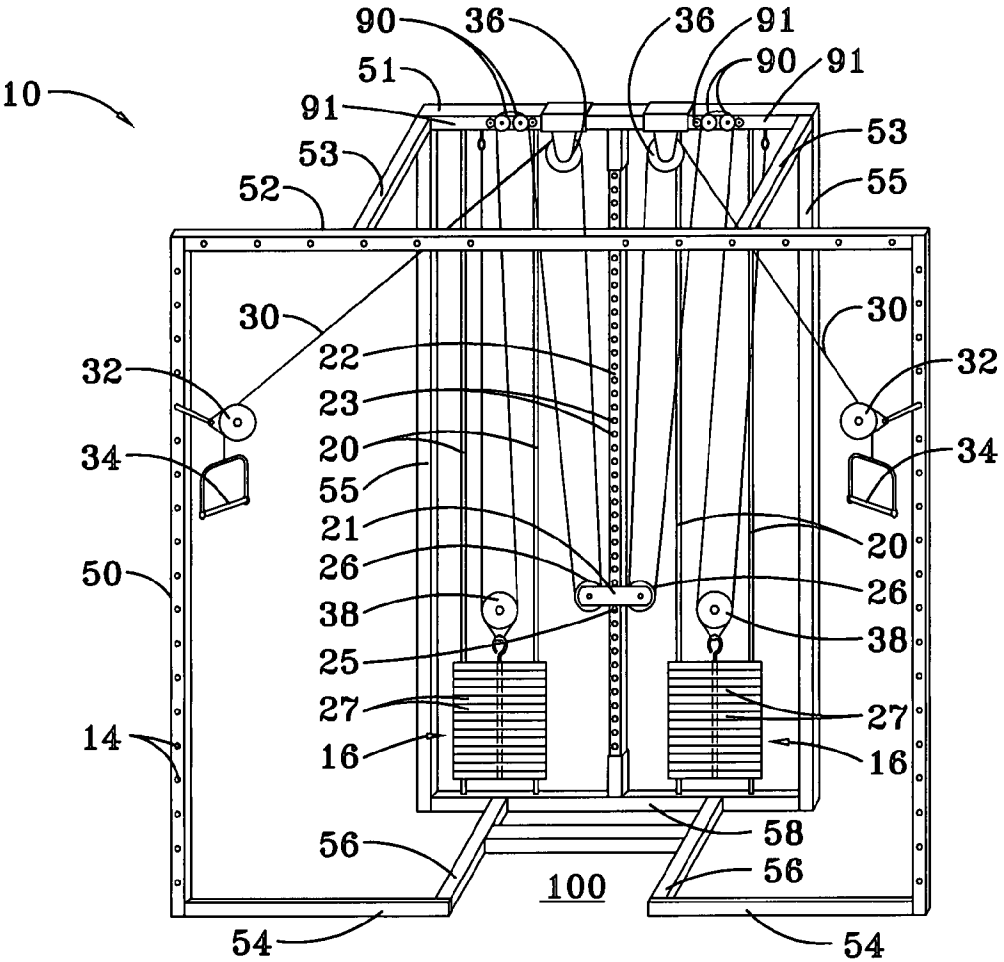
FIG. 2 is a front, perspective view of the entire apparatus.

A first embodiment of the exercise apparatus of the present invention, denoted generally by the numeral 10, is depicted in FIG. 2. The apparatus 10 includes a frame 12, depicted separately for clarity in FIG. 1. The frame 12 comprises an assembly of straight, hollow, tubular, members, each member preferably being of square cross-section (not shown). The frame 12 includes vertical, left and right front members 50, the upper ends of which are joined by a horizontal, front cross bar 52; a top, rear cross bar 51 disposed parallel to, and to the rear of, the front cross bar 52, the opposite ends of said cross bar 51 being joined to the front cross bar 52 by a parallel pair of laterally spaced-apart, upper brace members 53; vertical, left and right, rear members 55 that each extend from a lower end to an upper end, said upper ends being attached to the opposite ends of the top, rear cross bar 51; a horizontal, weight stack support member 58 that joins the lower ends of the left and right, rear members 55; horizontal, left and right base members 54 having first ends 54F attached to lower ends of the left and right, front members 50 and extending part way toward each other and terminating in opposite, second ends 54S; and horizontal, left and right lower brace members 56 that join the second ends 54S of the left and right base members 54 to left and right portions of the weight stack support member 58, respectively. Certain ones of the frame members—that is, those denoted in the drawings as 50, 52, 54 and 58—have spaced-apart openings 14. These openings 14 are labeled with indicia—for example, proceeding clockwise, as viewed from the front of the apparatus, from a central portion of the top, cross member 52, the openings 14 are labeled A, B, C, D, et cetera, proceeding down the right, front member 50, leftwards along the right base member 54, and leftwards along a right portion of the weight stack support member 58; and, the openings in the left half portion of the frame are similarly labeled sequentially in a counterclockwise direction as viewed from the front of the apparatus, as A, B, C, D, et cetera. In a preferred embodiment, the frame 12 has overall width of eight feet two inches, height of seven feet six inches, and depth two feet, which makes the apparatus suitable for installation in residences as well as in commercial fitness centers and in clinics for physical therapy and rehabilitation.

Also depicted in FIGS. 1 and 2 is a vertical stanchion 22 disposed intermediate the left and right, rear members 55 and extending upward from a central portion of the weight stack member 58 to a central portion of the top, rear cross bar 51. The vertical stanchion 22 preferably comprises Unistrut® and has a plurality of vertically spaced-apart openings 23, which are preferably labeled sequentially 1 through 35. Unistrut® is a registered trademark of Unistrut Corporation of Wayne, Mich. Slidably mounted on the stanchion 22 for vertical travel is a carriage assembly, denoted generally by the numeral 21. A user can choose the vertical position of the carriage assembly 21 by manually pushing it up or down along the stanchion 22, and then fix it in a desired position by inserting a carriage pin 25 into an opening 23 at the desired position of the carriage assembly. The carriage assembly 21 carries left and right carriage pulleys 26 in laterally spaced apart, side-by-side relation, which pulleys are mounted therein for rotation about horizontal axes.

Figure 3:
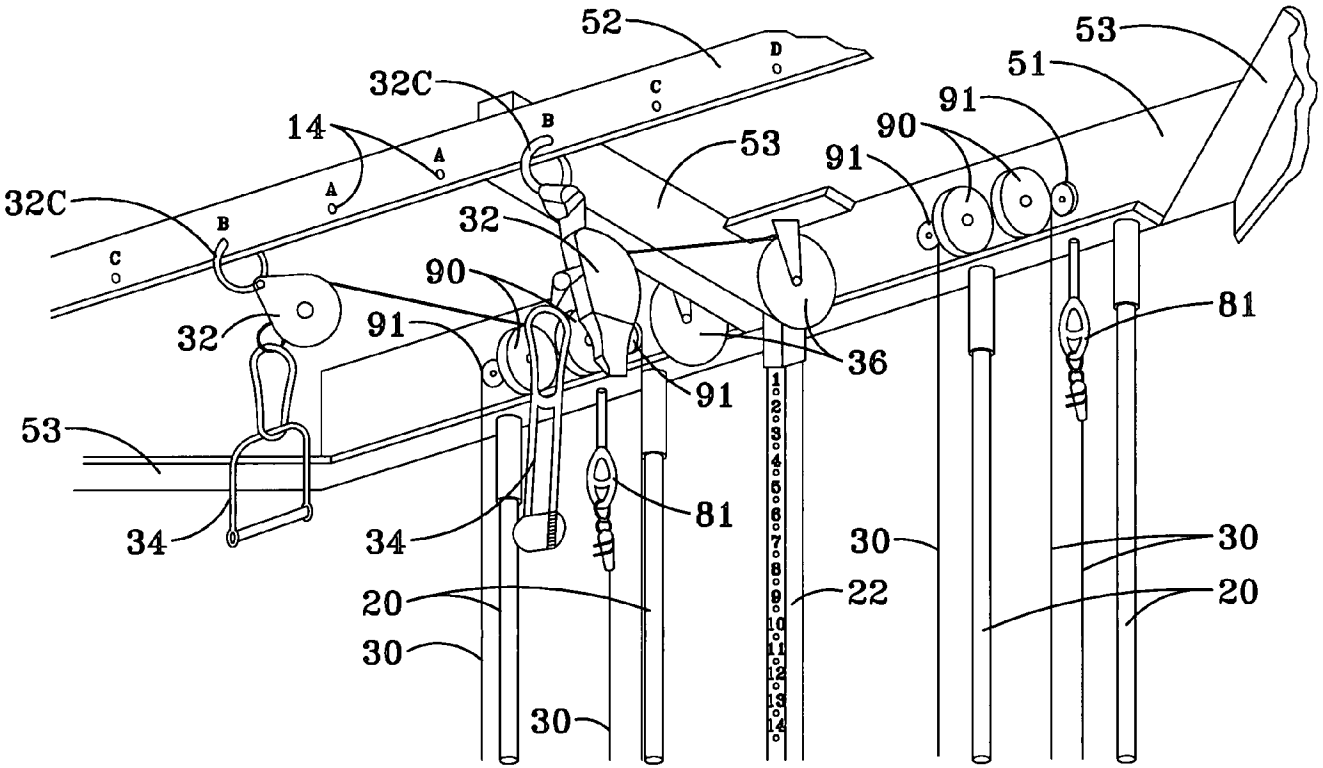
FIG. 3 is a fragmentary, front, perspective view of an upper portion of the apparatus.
Figure 4:
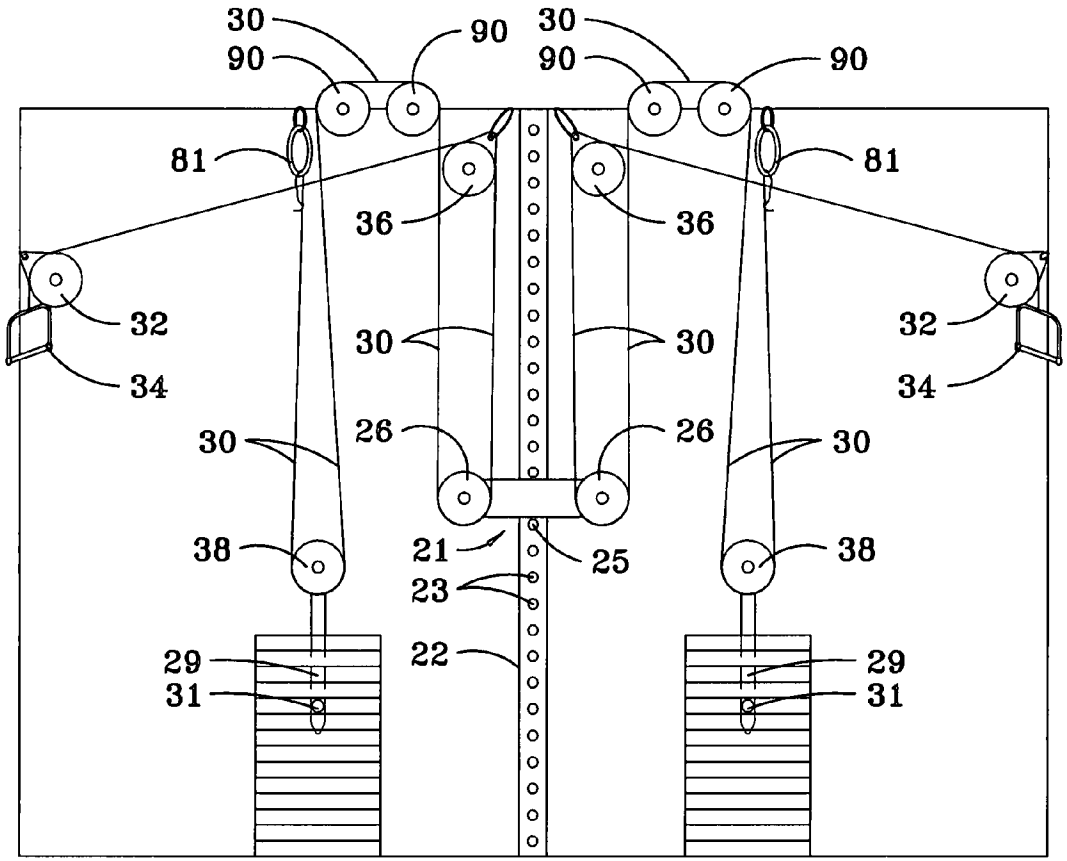
FIG. 4 is schematic diagram showing an arrangement of pulleys and cables according to the invention.
Figure 14:
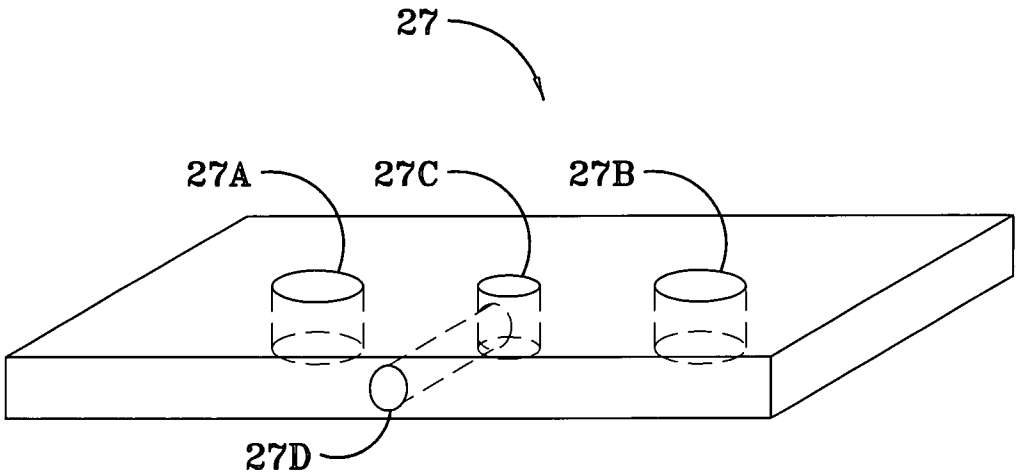
FIG. 14 (PRIOR ART)
FIG. 14 is an enlarged, frontal, perspective view of a single weight plate of the kind employed in the present invention.

Referring now to FIGS. 2, 3 and 4, the apparatus further includes left and right weight stack assemblies 16. Each weight stack assembly 16 includes a pair of horizontally spaced-apart, vertical guide rods 20 that extend from the weight stack support member 58 up to the rear cross bar 51. Each weight stack assembly 16 further includes a plurality of triply-apertured, horizontal, weight plates 27 (FIG. 14) mounted for vertical, sliding movement along the guide rods 20, and a vertically-disposed weight post 29 or bayonet (depicted in phantom lines in FIG. 4) inserted through a central aperture of each of the weight plates. Each weight post 29 has vertically spaced-apart openings into which may be inserted a horizontally-directed weight pin 31 to select a desired number of weight plates 27 for attachment to the weight post.

Left and right swivel pulleys 36, 36 are mounted to the top, rear cross bar 51 on opposite sides of an upper portion of the stanchion 22 such that the hub and rim portions of each swivel pulley extend downward from the cross bar 51 and are free to rotate about a substantially vertical axis. Mounted to a front surface of the top, rear cross bar 51, on opposite sides of the left and right swivel pulleys 36, 36, are left and right pairs of guide pulleys 90, 90. The guide pulleys of each pair 90, 90 are disposed in side-by-side relation for rotation of the pulley wheels thereof around parallel, horizontal axes. For each pair of guide pulleys 90, 90, pairs of guide rollers 91, 91 are mounted on the front surface of the top, rear cross bar 51 on opposite sides of, and adjacent to, each pair of guide pulleys 90, 90 for rotation about parallel, horizontal axes.

Attached to an upper end of each of the left and right weight posts 29, 29 is a weight stack pulley 38, 38. The pulley wheels of the weight stack pulleys 38 are oriented for rotation about horizontal axes. Left and right, downwardly directed, turnbuckles 81 are mounted to the top, rear cross bar 51 above the left and right weight stack pulleys 38, 38. Left and right hand pulleys 32, 32 are provided and each has an upper, claw end 32C that is insertable into any one of the indicia-labelled openings 14 in the frame 12.

Left and right, cables 30, 30 are provided, preferably steel cables, each of which are routed through the apparatus as here described for the left cable 30. It will be understood that the same route description applies to the right cable 30 if one substitutes the term "right" for the term "left". Referring to FIGS. 2 and 4, it may be seen that a first end of the left cable 30 is attached to a left turnbuckle 81. From the left turnbuckle 81, the left cable 30 descends down, underneath, and around a left, weight stack pulley 38, thence vertically upward to a left portion of the top, rear cross bar 51 where the left cable is routed between a left guide roller 91 and a first of a pair of left guide pulleys 90, thence over both left guide pulleys of said pair of left guide pulleys 90, thence down to, underneath, and around a carriage left pulley 26, thence up to, over, and around a left swivel pulley 36, and thence to, over, and around a left hand pulley 32, and thence down to a second, opposite end of the left cable 30 that is attached to a left hand grip 34. The guide rollers 91 help prevent the cable 30 from slipping off the guide pulleys 90.

Figure 5:
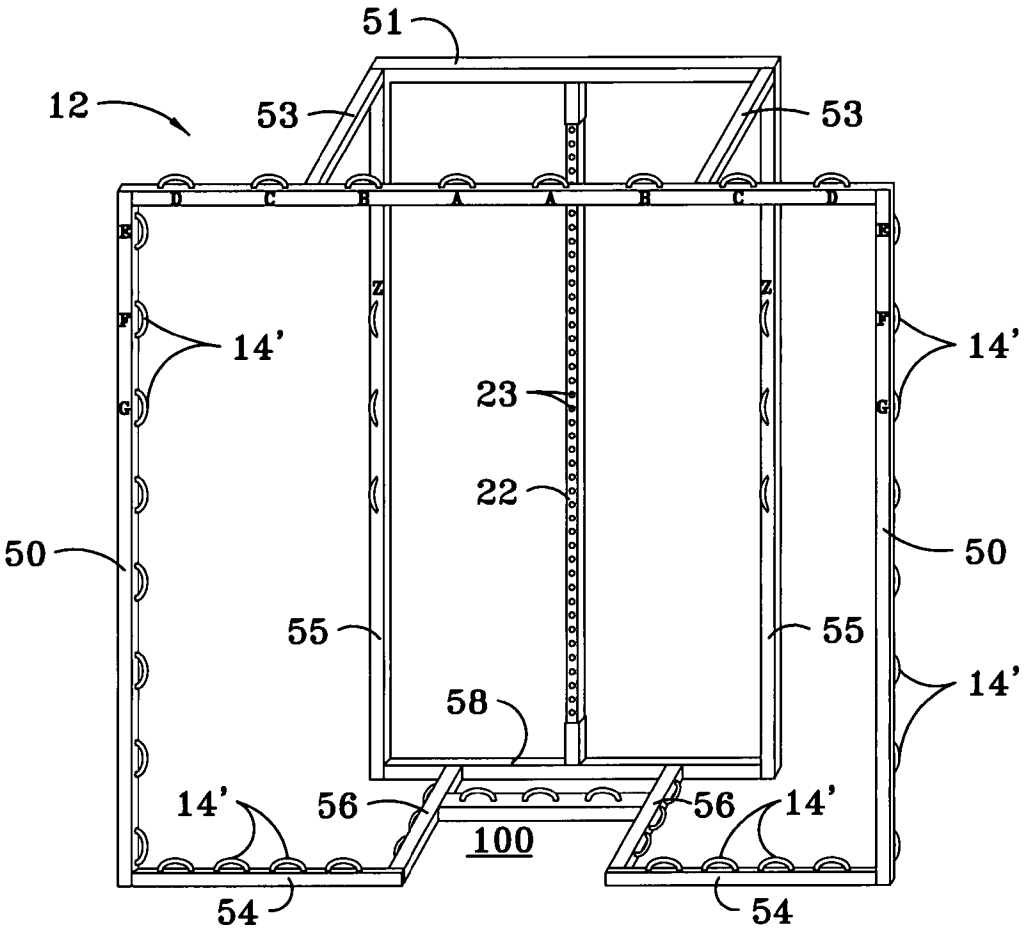
FIG. 5 is a reprise of FIG. 1, except that indicia-labelled, individual chain links are substituted for openings in the frame of the apparatus.
Figure 6:
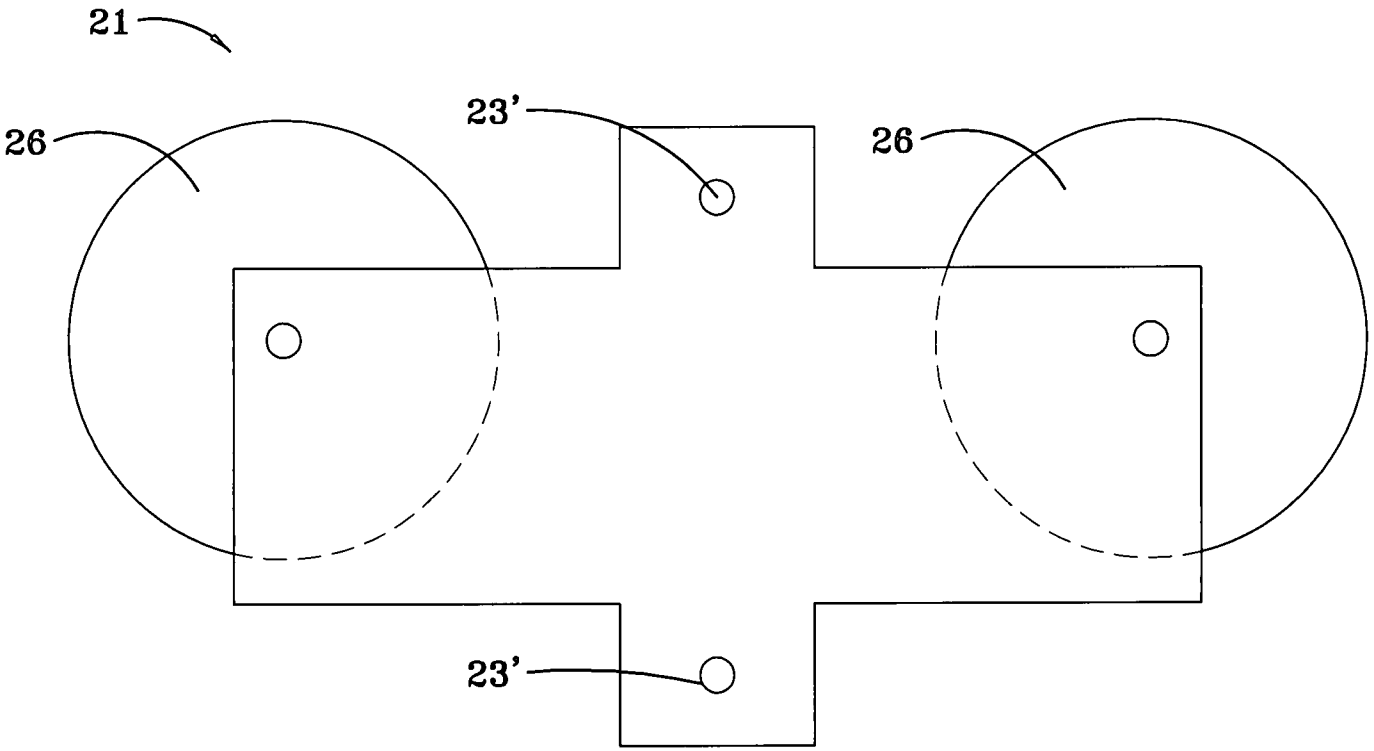
FIG. 6 is an enlarged, front, elevational view of an alternate embodiment of a carriage assembly of the apparatus, which alternate assembly is depicted separated from the remainder of the apparatus and is shown to have an upper opening and a lower opening for insertion of a carriage pin.

In a preferred, alternate embodiment, as depicted in FIG. 6, the carriage assembly 26 has two vertically spaced-apart openings 23', which increases the number of possible locations for setting the height of the carriage assembly 21 on the vertical stanchion 22 by insertion of a carriage pin 25 into either of said openings 23'. Further, as depicted in FIG. 5, individual chain links 14' are substituted for the openings 14 in the frame 12.

Open space 100 is provided within the frame 12 for a user to place an exercise bench or to stand, sit, lie or kneel while performing bodily exercises with the apparatus. There are just three kinds of adjustments that a user will make to the apparatus 10 during a work out session. As he proceeds from one exercise routine, to the next, he will reposition the hand pulleys 32, 32, and/or change the number of weight plates 27 attached to the weight pulleys 38, 38, and/or adjust the amount of slack in the cables 30, 30 by repositioning the rest position of the carriage assembly 21. The configurations of the hand pulley 32, 32 positions and of the carriage assembly 21 can be notated using the labeled indicia for ease of reference by the user—such as "22 [carriage assembly position], D [left hand pulley position], D [right hand pulley position]." The range of bodily exercises that can be so notated and performed with the apparatus 10 can include, for instance, squats, dead lifts, bench presses, pull downs, pull ups bent-over rows, seated rows, punching movements, the clean and jerk, chest flyes, back flyes, et cetera.

Figure 7:
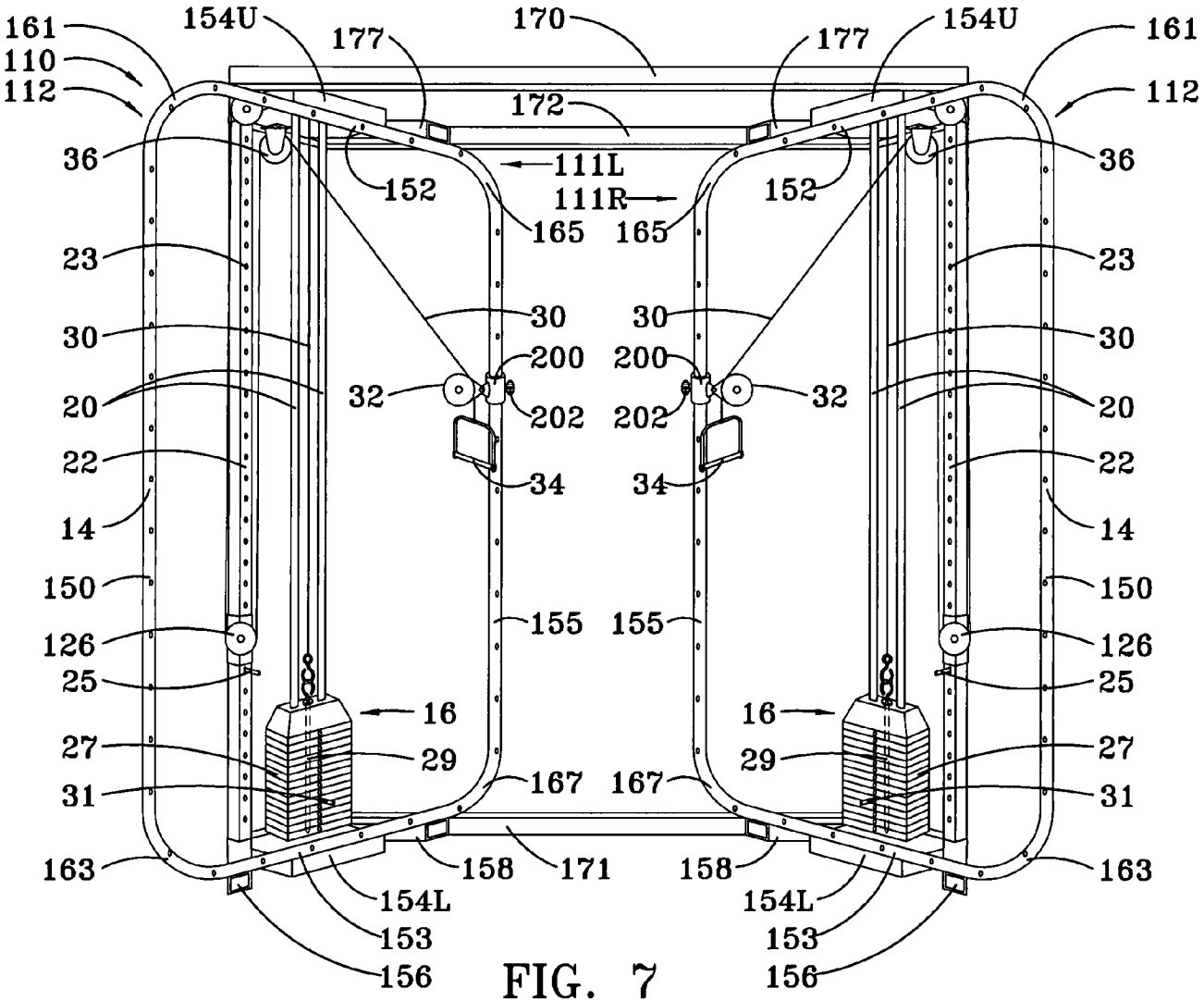
FIG. 7 is a front, perspective view of a second embodiment of the invention.

A second, alternative embodiment 110 of the present invention is depicted in FIG. 7, wherein, among other changes, hollow, tubular frame members having circular cross-section are substituted for the hollow, square cross-section, tubular frame members of the first embodiment 10. The frame 112 includes a left rectangular loop 111L and a right rectangular loop 111R, which loops are laterally spaced apart, of equal size, and oriented at an angle θ with respect to each other, where θ is preferably in the range 70° to 130°, and most preferably 90°. Each loop 111L, 111R includes a horizontal top member 152 and a horizontal bottom member 153, an outer, vertical member 150 and an inner vertical member 155, an upper, outer corner 161 that joins the top member to the outer vertical member, a lower, outer corner 163 that joins the outer, vertical member to the bottom member, an upper, inner corner 165 that joins the top member to the inner, vertical member, and a lower, inner corner 167 that joins the inner, vertical member to the bottom member. Each of the corners 161, 163, 165, 167 is rounded through a 90° angle such that each loop 111L, 111R, although generally rectangular, has four rounded corners. As depicted in FIG. 7, the frame 112 further includes a horizontal, rear, top cross bar 172 that joins the upper, inner corners 165, 165 to each other; a horizontal, front, top cross bar 170 that joins the upper, outer corners 161, 161 to each other; a horizontal, bottom cross bar 171 that joins said lower, inner corners 167, 167 to each other. Thus, the rear, top cross bar 172, the front, top cross bar 170 and the bottom bar 171 maintain the loops 111L, 111R in fixed positions with respect to each other. It will be understood by persons of ordinary skill in the art, however, that, although it is essential that means be provided to maintain said loops 111L, 111R in fixed positions with respect to each other, that can be accomplished in other ways as, for example, by attaching the bottom member 153 of each of the loops to a floor surface of an exercise room and the top member 152 of each of the loops to a ceiling surface of the room with appropriate fasteners, such as U bolts (not shown).

Figure 9:
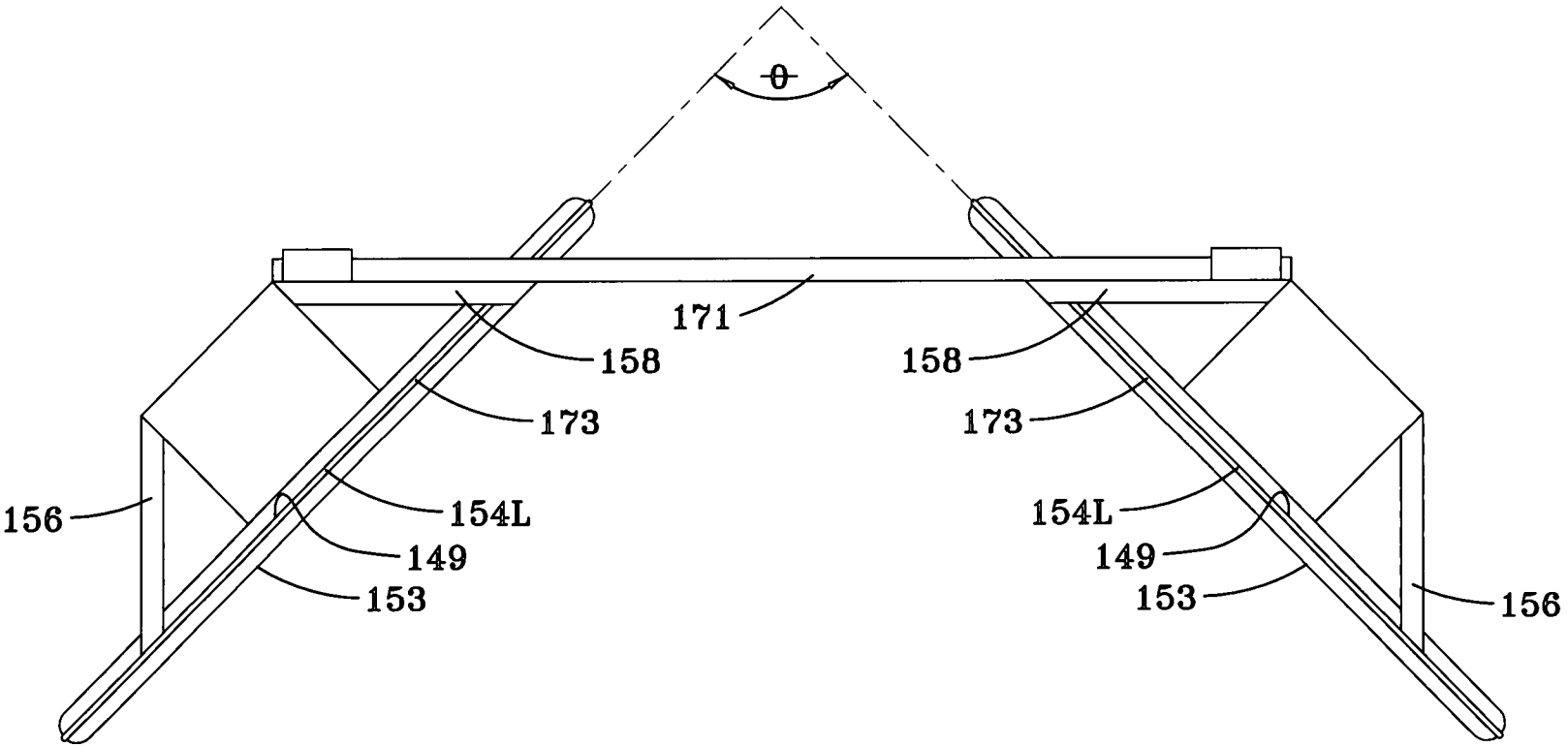
FIG. 9 is a top, plan view of a bottom portion of the frame of the second embodiment as it appears prior to attachment thereto of the left and right stanchions and weight stack assemblies.

Referring to FIGS. 7 and 9, the frame 112 further includes flat, horizontal, rectangular, left and right, lower weight stack mounting plates 154L, 154L, each said plate being disposed below a top member 152 and having front edge 149 attached to a central portion of a bottom member 153 from which it extends perpendicularly and rearwardly. For each lower weight stack mounting plate 154L, 154L, a first support brace 156 extends rearwardly from the bottom member 153 to which it is attached to a first, rear portion of said plate, and a second, opposite, rear portion of each said plate is attached to the nearest end of the bottom cross bar 171. A second support brace 158 extends from a rear portion of the bottom member 153 to said second, rear portion of each said lower weight stacking plate 154L, 154L.

Figure 8:
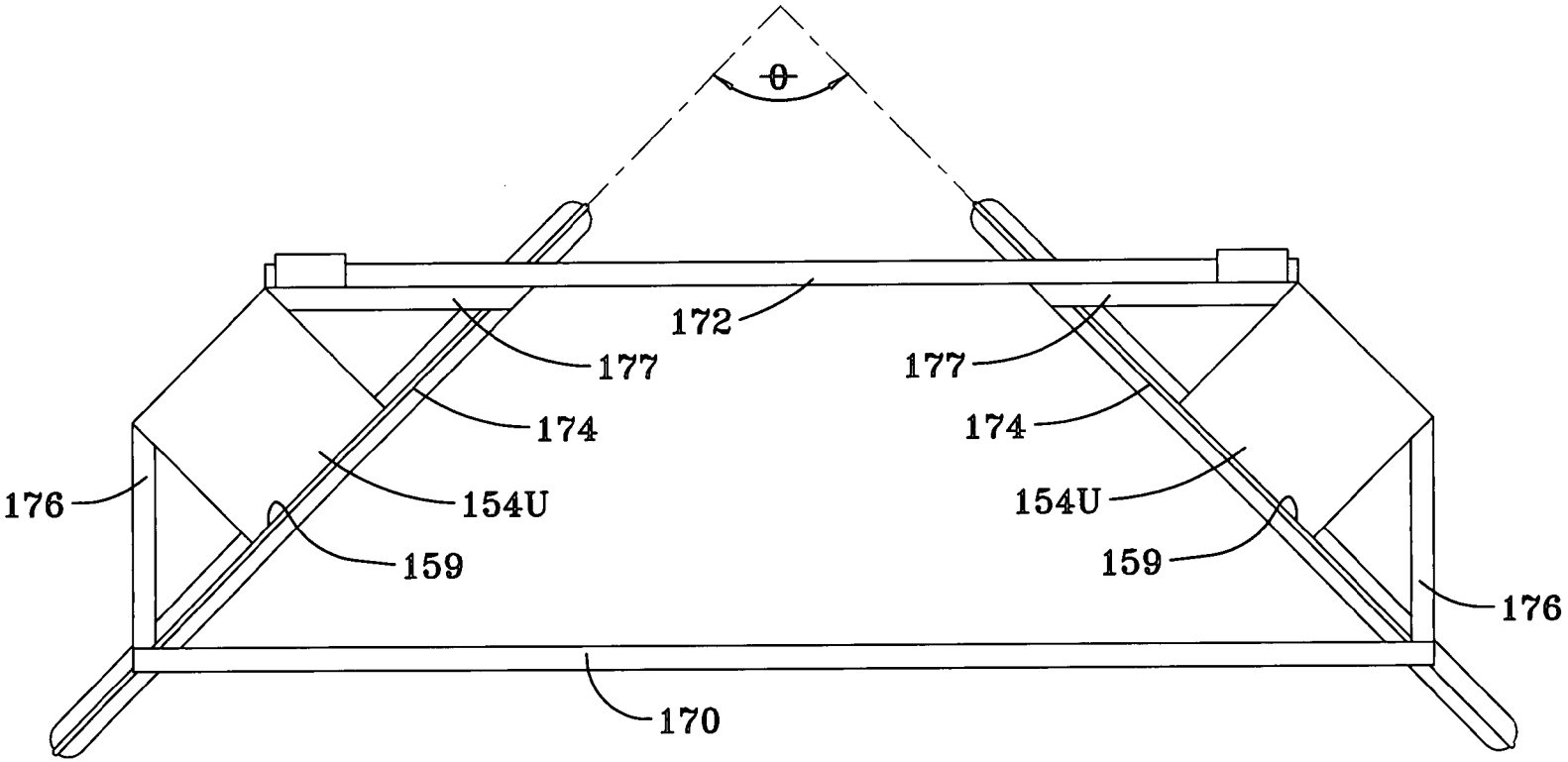
FIG. 8 is a top, plan view of the frame of the second embodiment of the invention.
Figure 10:
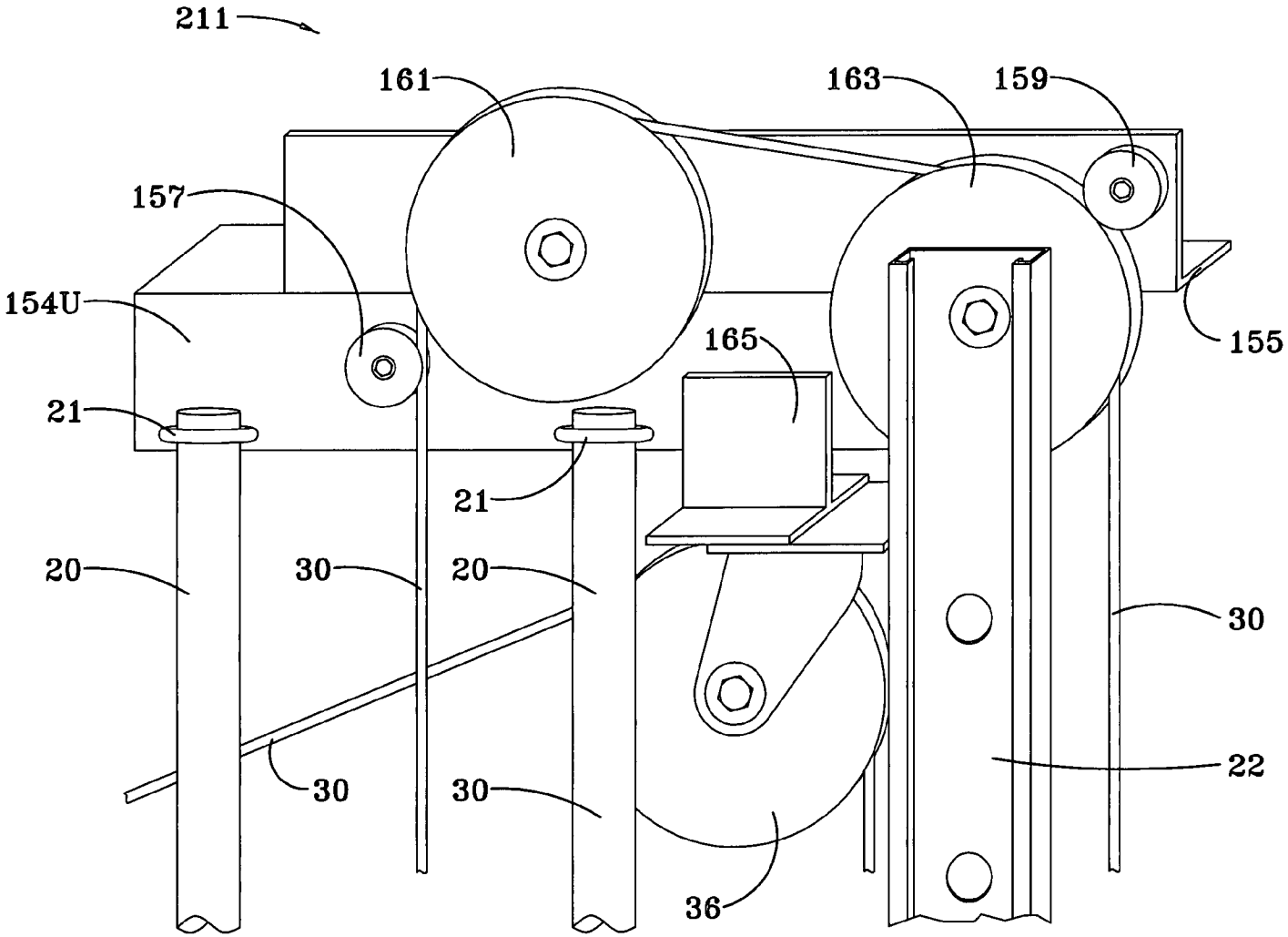
FIG. 10 is an enlarged, rear, perspective view of a left, upper portion of the second embodiment of the invention, showing the upper pulley means and swivel pulley attached to the left, upper weight stack mounting plate.
Figure 11:
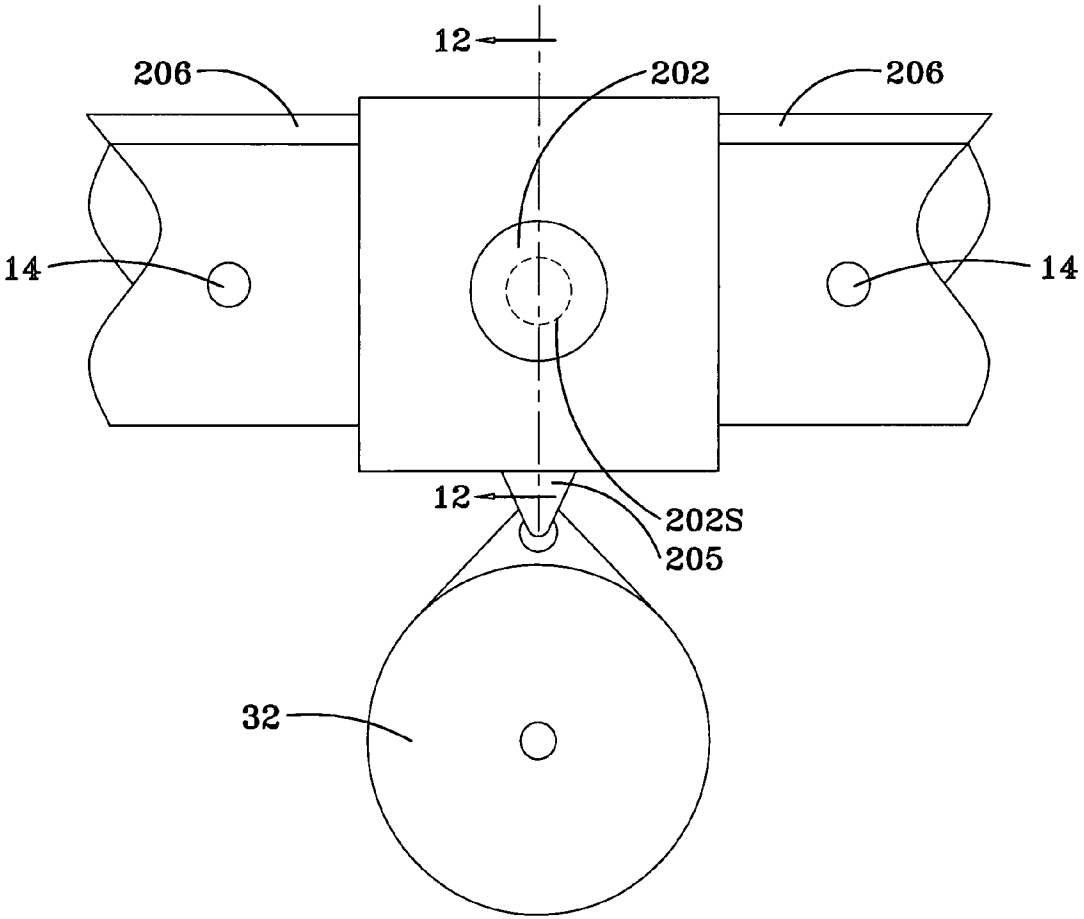
FIG. 11 is an enlarged, front elevational view of a slotted collar clamp assembly slidably mounted on the tubular frame thereof, from which is suspended a hand pulley.
Figure 12:
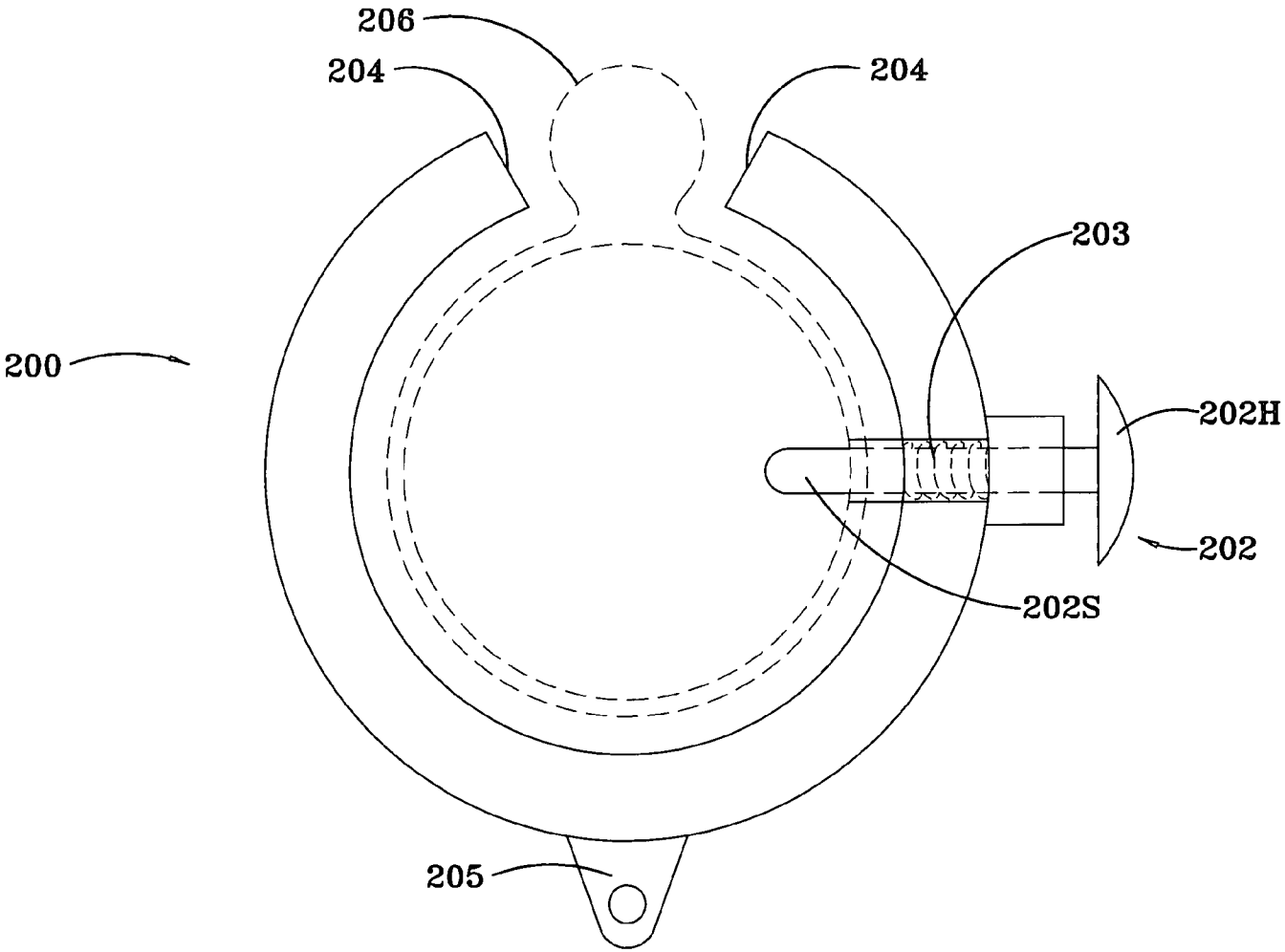
FIG. 12 is a cross-sectional view thereof taken along line 12-12 of FIG. 9, wherein the tubular frame and its peripheral track are depicted in phantom lines for clarity.
Figure 13:
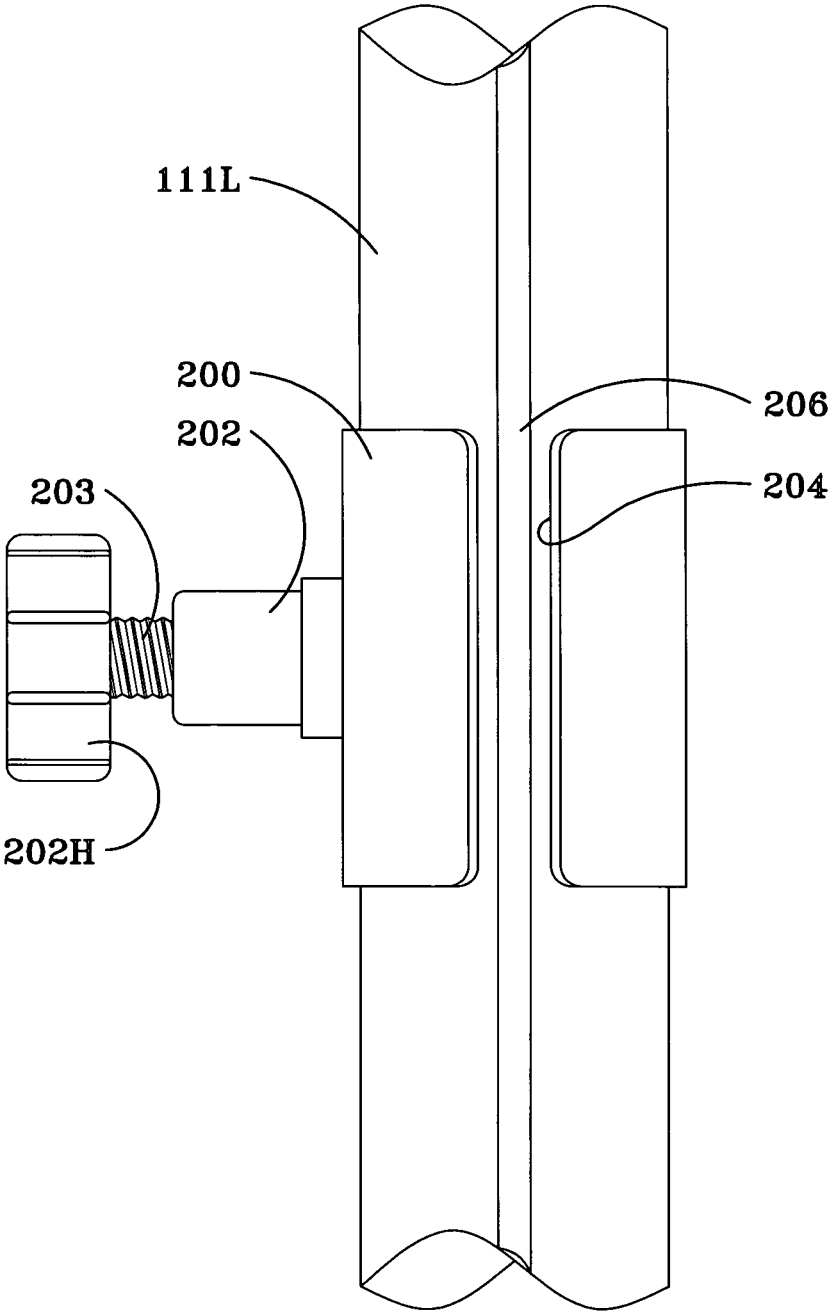
FIG. 13 is a right side, elevational view thereof, with the hand pulley removed therefrom for the sake of visual clarity.

As illustrated in FIGS. 7, 8 and 10, the frame 112 also includes flat, horizontal, rectangular, left and right upper weight stack mounting plates 154U, 154U disposed above the left and right, lower weight stack mounting plates, 154L, 154L, respectively. The size of the upper weight stack mounting plates 154U, 154U is about equal to that of the lower weight stack mounting plates 154 U, 154. To a central portion of a top member 152 of each loop 111L, 111R is attached a front edge 159 of one of the upper weight stack mounting plates 154U, 154U, which plates extend perpendicularly and rearwardly from said top member. For each upper weight stack mounting plate 154U, 154U, a first support brace 176 extends rearwardly from the top member 153 to which it is attached to a first, rear portion of said plate, and a second, opposite, rear portion of each said plate is attached to the nearest end of the rear, top cross bar 172. For each upper weight stack mounting plate 154U, 154U, a second support brace 158 extends from a rear portion of a top member 153 to said second, rear portion of said plate. The support braces 156, 158, 176, 177 preferably comprise square steel tubing.

In order to maintain the loops in fixed positions with respect to each other, a front, top cross bar 170 extends between, and joins, front portions of the top members 152, 152, and rear, top cross bar 172 extends between, and joins, said second rear portions of each of the upper weight stack mounting plates, and is attached to rear portions of the top members 152, 152 as well. Alternative means for maintaining the loops in fixed positions with respect to each other are possible, however, such as by attaching with U bolts (not shown) the upper and lower weight stack mounting plates 154U, 154L to a floor and ceiling of an exercise room, respectively.

For each loop 111L, 111R, a vertical stanchion 22 extends from, and joins, its lower weight stack mounting plate 154L to its upper weight stack mounting plate 154U. Each vertical stanchion 22 preferably comprises Unistrut® and has a plurality of vertically spaced-apart openings 23, which are preferably labeled sequentially 1 through 35. A pulley carriage 126 is mounted to each of the left and right stanchions 22, 22 for vertical travel thereon, and each pulley carriage carries a single carriage pulley that is disposed for rotation about a horizontal axis. For each pulley carriage 126, a carriage pin 25 is provided that is insertable into a stanchion opening 23 immediately below the carriage or through an aperture in the carriage itself and thence into a stanchion opening. Thus, the vertical positions of each of the pulley carriages can be separately adjusted on the stanchions 22, 22 merely by removing the pins 125, 125, sliding the pulley carriages up or down on the stanchions to desired, new locations, then reinserting the pins into the stanchion openings 14 to retain the carriages in their new locations.

Left and right weight stack assemblies 16, 16 are disposed over the left and right, lower weight stack mounting plates 154U, 154U, respectively. Referring to FIG. 7, each weight stack assembly 16 includes a weight pin 31; a pair of laterally spaced-apart, vertical guide rods 30, 30 that extend from the lower, weight stack mounting plate 154L up to the upper, weight stack mounting plate 154U; and a plurality of horizontal, vertically-stacked, weight plates 27 mounted for vertical, sliding movement along the guide rods. Each weight plate 27 has a pair of laterally spaced apart, vertically-directed openings 27A, 27B through which the guide rods 30, 30 are inserted (or are upper and lower weight stack mounting plates 154U, 154L to a floor and ceiling of an exercise room, respectively.

For each loop 111L, 111R, a vertical stanchion 22 extends from, and joins, its lower weight stack mounting plate 154L to its upper weight stack mounting plate 154U. Each vertical stanchion 22 preferably comprises Unistrut® and has a plurality of vertically spaced-apart openings 23, which are preferably labeled sequentially 1 through 35. A pulley carriage 126 is mounted to each of the left and right stanchions 22, 22 for vertical travel thereon, and each pulley carriage carries a single carriage pulley that is disposed for rotation about a horizontal axis. For each pulley carriage 126, a carriage pin 125 is provided that is insertable into a stanchion opening 14 immediately below the carriage or through an aperture in the carriage itself and thence into a stanchion opening. Thus, the vertical positions of each of the pulley carriages can be separately adjusted on the stanchions 22, 22 merely by removing the pins 125, 125, sliding the pulley carriages up or down on the stanchions to desired, new locations, then reinserting the pins into the stanchion openings 14 to retain the carriages in their new locations.

Left and right weight stack assemblies 16, 16 are disposed over the left and right, lower weight stack mounting plates 154U, 154U, respectively. Referring to FIG. 7, each weight stack assembly 16 includes a weight pin 31; a pair of laterally spaced-apart, vertical guide rods 30, 30 that extend from the lower, weight stack mounting plate 154L up to the upper, weight stack mounting plate 154U; and a plurality of horizontal, vertically-stacked, weight plates 27 mounted for vertical, sliding movement along the guide rods. Each weight plate 27 has a pair of laterally spaced apart, vertically-directed openings 27A, 27B through which the guide rods 30, 30 are inserted (or are insertable), a vertically-directed, central opening 27C, and a horizontally-directed opening 27D that is dimensioned to receive a weight pin 31 and is aligned with said central opening; see FIG. 14. Each assembly 116 further includes a weight post 29 inserted (or insertable) through the central opening 27C of each of the weight plates 27. Each weight post 29 has vertically spaced apart openings, such that a weight pin 31 inserted through a horizontally-directed opening of any of the weight plates 27 may be further inserted into any one of the openings of the weight post to thereby select a desired number of weight plates for attachment to the weight post—i.e., all the weight plates attached to and/or disposed above the weight pin.

The second embodiment of the invention 110 further includes left and right swivel pulleys 36, 36 mounted to upper, left and right portions of the frame 112, respectively, which swivel pulleys are substantially identical to those of the first embodiment 10. In the illustrated second embodiment as depicted in FIG. 10, the swivel pulleys 36, 36 are suspended from angle brackets 165, 165 attached to the left and right upper, weight stack mounting plates 154U, 154U. FIG. 10 further shows that, for each of the weight stack assemblies 16, 16, upper ends of the guide rods 30, 30 are attached by U bolts 21, 21 to a rear surface of an upper, weight stack mounting plate 154U. Left and right, upper pulley means 211 is attached to left and right upper portions of the frame 112, respectively, which means, as illustrated in FIG. 10, includes a first pulley 161 and a laterally spaced apart, second pulley 163 attached to a rear surface of an upper, weight stack mounting plate 154U for rotation about horizontal axes. For each of said upper pulleys 161, 163 there are provided an adjacent guide roller 157, 159, respectively, which rollers are also rotatable about horizontal axes, for retaining the cables 30, 30 on said pulleys. As depicted, the guide roller 157 is mounted to an upper, weight stack mounting plate 154U, whereas the guide roller 159 is mounted to an angle bracket 155 attached to said plate.

Referring now to FIGS. 7, 11-13, it is seen that for each loop 111L, 111R of the second embodiment 110 a hand pulley 32 is provided that is suspended from a slotted collar assembly 200 slidably mounted to the loop. Each slotted collar assembly 200 includes a cylindrical collar 201 having an internal diameter slightly greater than the external diameter of the tubular members of the loops 111L, 111R, an apertured ear 205 that projects radially from a peripheral surface of the collar, and a collar pin 202. The collar pin 202 includes a shaft portion 202S that is inserted through a radially-directed, aperture 209 of the collar, which aperture is circumferentially spaced away from the apertured ear 205, a broadened, head portion 202H attached to the shaft external to the aperture, and a coil spring 203 circumposed about the shaft portion that urges it radially inward into the aperture. A longitudinally-directed, slotted cut out 204 of uniform width extends entirely through the wall of the collar and throughout the full longitudinal length of the collar 201 in a direction parallel to the collar axis. Such a collar pin is available, for instance, from McMaster-Carr of Elmhurst, Ill., item number 90222A518. As shown in phantom outline in FIG. 12, a guide track or bead 206 is attached to, or integrally incorporated into, a peripheral surface of each of the members of each loop 111L, 111R, and extends continuously around each of the loops, except where the lower, weight stack plate 154L and the upper weight stack plate are attached to said loops. The width of each cutout 204 is a little greater than the width of the track 206 in order to permit the cutouts 204 to receive, and the collars 201, 201 to slide along, the tracks. The portions of the tracks 206 that are nearest to the places where the upper and lower weight stack plates 154U, 154L are attached to the loops 111L, 111R are aligned with downturned flanges at the front edges 179, 189 of those plates, respectively, such that the slotted collar assemblies 200, 200 can be smoothly slid across those junctions. The left and right hand pulleys 32, 32 are suspended from the collars 201, 201, as by claw projections from the pulleys inserted into apertures in the ears 205 of the collar assemblies 200, 200, such that the pulleys can be placed at whatever location around each of the loops 111L, 111R a user may select. Preferably, as in the first embodiment 10, the openings on the stanchions 22 of the second embodiment bear indicia such as numbers 1 through 32 (not shown), and the openings 14 on the left and right loops 111L, 111R also bear indicia, such as the letters A through Z (not shown).

Figure 15:
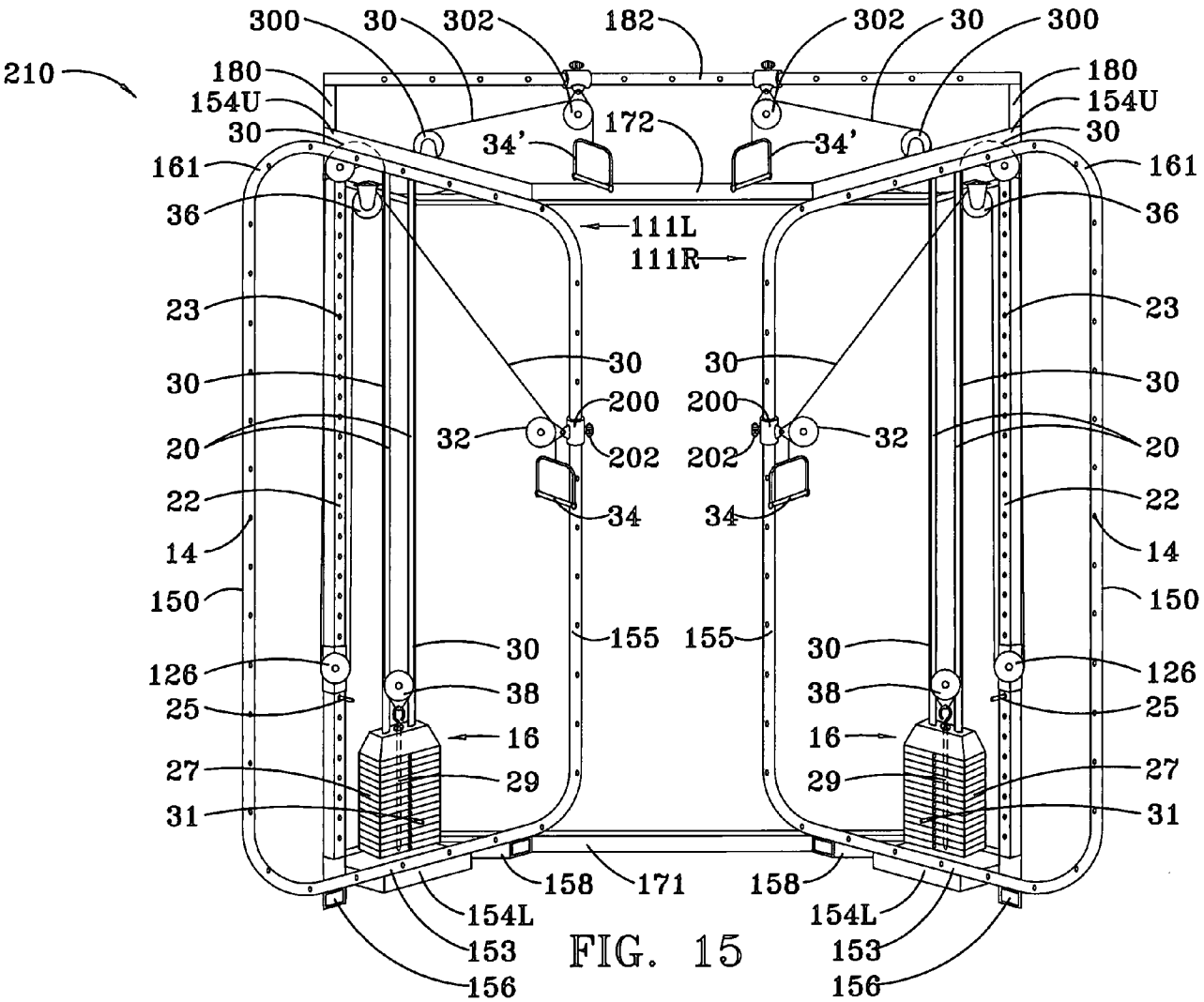
FIG. 15 is a front, perspective view of a third embodiment of the present invention, intended for physically impaired and wheelchair-bound persons.

In a third embodiment 210 of the present invention, the second embodiment 110 is modified to adapt it for use by physically impaired persons, including wheelchair-bound persons. As illustrated in FIG. 15, the third embodiment 210 retains from the second embodiment 110 the following components: the left and right loops 111L, 111R laterally spaced apart at an angle θ; the left and right, upper weight stack mounting plates 154U, 154U, and lower weight stack mounting plates 154L, 154L attached to, and extending rearwardly from, the upper members 152, 152 and the lower members 153, 153 of said loops, respectively; the left and right stanchions 22, 22 extending between said upper and lower weight stack mounting plates, respectively; the rear, upper braces 176, 176; the front, upper braces, 176, 176; the rear, lower braces 158, 158; the lower, front braces 156, 156; left and right pulley carriages 126, 126 mounted on said stanchions for vertical travel, each carrying a single carriage pulley mounted for rotation about a horizontal axis; left and right weight stack assemblies 16, 16 comprised of the same components as the weight stack assemblies of the second embodiment and similarly disposed between the lower weight stack mounting plates and the upper weight stack mounting plates; left and right slotted collar assemblies 200, 200 comprised of the same components as those of the second embodiment, and slidably mounted in the same manner on the left and right loops; a lower, cross bar 171 that extends between, and joins rear, lower portions of the left and right loops; an upper, rear cross bar 172 that extends between, and joins, upper, rear portions of the loops; left and right upper pulley means 211 attached to upper rear portions of the frame, as depicted, for example, in FIG. 10; left and right swivel pulleys suspended from the left and right, upper weight stack mounting plates, respectively; and left and right cables 30, 30, which cables, however, are routed somewhat differently in the third embodiment. As in the second embodiment, the frame includes an upper, front cross bar 170, but that cross bar is elevated above the loops 111L, 111R by having its opposite ends joined to the left and right, upper weight stack mounting plates 154U, 154U by upstanding, left and right, vertical spacers 180, which spacers extend upward from the left and right, upper weight stack mounting plates, respectively. Compared to the second embodiment, the loops 111L, 111R of the third embodiment are more squat (i.e., have lesser height) in order to improve accessibility of the invention to wheelchair-bound persons. The third embodiment 210 eliminates the left and right turnbuckles employed in the second embodiment 110. Instead, upper ends of the weight posts 29, 29 are attached to weight stack pulleys 38, 38 disposed for rotation about horizontal axes. Moreover, unlike the second embodiment 110, the third embodiment 210 provides a second pair of laterally spaced apart, left and right, top pulleys 302, 302 mounted to the upper, front cross bar 170 for rotation about horizontal axes.

The routing of the left cable 30 of the third embodiment 210 is as follows. A first end of the left cable 30 is attached to a first, left hand grip 34'; extends thence up to, over and around the left, top pulley 302; thence over and around a first, left swivel pulley 300; thence down to, underneath and around the left weight stack pulley 38; thence up to, over and around the left, upper pulley means 211 (depicted by dashed lines in FIG. 15); thence down to, underneath and around the left carriage pulley 126; thence up to, over and around a second, left swivel pulley 36; thence to, over and around the left hand pulley 32 (wherever on the left loop 111L it may be situated) and thence to a second, opposite end that is attached to the second, left hand grip 34. The routing of the right cable 30 of the third embodiment 210 is the same if we but substitute the word "right" for the word "left."

The following components of the third embodiment are accessible for manipulation by a person seated in a wheelchair (not shown) adjacent to the weight stacks 16, 16: the weight stack pins 31, 31, which permits adjusting the number of weight plates 27 attached to each of the weight posts 29, 29; the pulley carriages 126, 126 and pulley carriage pins 25, 25, which permits adjusting the height of the carriages 126 on the stanchions 22, 22; and even the locations of the slotted collar assemblies 200, 200 on the loops 111L, 111R by virtue of the reduced height of the loops. While it may appear from FIG. 15 that the second hand grips 34', 34' are out of reach of such a wheelchair-bound person that is not the case. The first hand grips 34, 34 are releasably attachable to the second ends of the cables 30, 30; that is, said hand grips have snap attachments (not shown) for quickly and easily attaching them to, and disattaching them from, the second ends of the cables 30, 30. To reach and grasp the second hand grips 34', 34', the first hand grips 34, 34 are detached from the second ends of the cables 30, 30. Then the carriage pulleys 126, 126 are relocated from a first, lower positions on the stanchions 22, 22 up to a second, higher positions on the stanchions, which creates slack in the cables 30, 30. The slack in the cables 30, 30 permits the second hand grips 34', 34' to descend low enough for a person seated in a wheelchair to grasp them. To aid in the initial lowering of the first hand grips 34, 34, prior to their removal from the second ends of the cables 30, 30, the first hand grips 34, 34 preferably are weighted to be heavier than the second hand grips 34', 34'.

Thus, it should be evident that an exercise apparatus according to the concepts of the present invention has been shown and described in sufficient detail to enable one of ordinary skill in the art to practice the invention. Variations on the disclosed embodiments of the invention are within the scope of the invention. For example, the turnbuckles 81 of the first embodiment 10 could be attached to the left and right, upper brace members 53 instead of to the top, rear cross bar 51. For further example, the left and right, lower base members 54, 54 and the left and right, lower brace members 56, 56 of the frame 12 of the first embodiment 10 might be omitted if one were to attach the lower ends of the front, vertical members 50 to a floor surface. Similarly, the cross bars 170, 171, 172 could be eliminated from the second embodiment 110 and/or third embodiment 210 by securing the loops 111L, 111R and/or the frame to a floor and/or ceiling of an exercise room. Since various modifications in the details, materials, and arrangement of parts, and equivalents thereof, are within the spirit of the invention, the scope of the invention should be limited solely by the scope of the appended claims.

I claim:

1. An exercise apparatus, comprising:

a frame, said frame having vertically and horizontally spaced apart openings, said frame including vertical, left and right front members, each said member extending from a lower end to an upper end thereof;

vertical, left and right rear members, each said member extending from a lower end to an upper end thereof;

a horizontal, front cross bar, said bar joining the upper ends of said front members;

a top, rear cross bar disposed parallel to, and rearward of, said front cross bar;

a pair of laterally spaced-apart, upper brace members, said members joining said top, rear cross bar to said front cross bar;

a horizontal, weight stack support member, said member joining the lower ends of said vertical, left and right rear members; and a vertical stanchion having a lower end attached to said weight stack support member and an upper end attached to said top, rear cross member, said stanchion having a plurality of horizontally-directed, vertically spaced apart openings;

a pulley carriage mounted to said stanchion for vertical travel, said carriage including left and right carriage pulleys disposed in side-by-side relation for rotation about horizontal axes;

a carriage pin insertable into any one of said openings in said stanchion to thereby fix the position of said carriage on said stanchion;

left and right weight stacks disposed intermediate said vertical, left and right rear members, each said weight stack including a weight pin;

a pair of laterally spaced-apart, vertical guide rods that extend from the weight stack support member up to the rear cross bar;

a plurality of horizontal, vertically-stacked, weight plates mounted for vertical, sliding movement along the guide rods, each weight plate having a pair of laterally spaced apart, vertically-directed openings through which said guide rods are inserted, a vertically-directed, central opening, and a horizontally-directed opening; and a vertical weight post inserted through said central opening of each of said weight plates, said post having vertically spaced-apart openings, such that insertion of said weight pin through said horizontally-directed opening of any of said weight plates may be further inserted into any of said openings of said post to thereby select a desired number of weight plates for attachment to the weight post;

left and right swivel pulleys mounted to the top, rear cross bar on opposite sides of the stanchion, each said pulley including a mounting bracket portion attached to said bar and pivotally depending therefrom hub and rim portions;

left and right pairs of laterally spaced apart guide pulleys attached to said top, rear bar on opposite sides of said left and right swivel pulleys, said guide pulleys being rotatable about horizontal axes;

left and right weight stack pulleys attached to upper end portions of said left and right weight posts, said pulleys being oriented for rotation about horizontal axes;

left and right turnbuckles attached to upper, right and left portions of said frame, respectively;

left and right hand pulleys, each said pulley having an upper, claw end that is insertable into any of the openings in the frame;

left and right handles; and left and right cables, wherein said left cable has a first end attached to said left turnbuckle and extends thence down and around said left, weight stack pulley, thence upward to a left portion of said top, rear cross bar where said cable is routed over and around said left pair of guide pulleys, thence down to and around said carriage left pulley, thence up to and around said left swivel pulley, thence to and around said left hand pulley, and thence to an opposite, second end of said left cable, said second end being attached to said left handle; and said right cable has a first end attached to said right turnbuckle and extends thence down and around said right, weight stack pulley, thence upward to a right portion of said top, rear cross bar where said cable is routed over and around said right pair of guide pulleys, thence down to and around said carriage right pulley, thence up to and around said right swivel pulley, thence to and around said right hand pulley, and thence to an opposite, second end of said right cable, said second end being attached to said right handle; and means for temporarily securing the left and right hand pulleys to user-selectable portions of the frame while said apparatus is being used to perform a bodily exercise.

2. The exercise apparatus of claim 1, wherein said frame and said cables are comprised of steel and further comprising left and right pairs of guide pulleys mounted on the top, rear cross bar on opposite sides of, and adjacent to, each pair of guide pulleys for rotation about horizontal axes.

3. The exercise apparatus of claim 2, wherein said top, rear cross bar has a front surface and said left and right pairs of guide pulleys are mounted on said front surface.

4. The exercise apparatus of claim 3, wherein the frame further includes horizontal, left and right base members having first ends attached to said lower ends of the left and right, front members and extending part way toward each other and terminating in opposite, second ends; and horizontal, left and right lower brace members that join the second ends of the left and right base members to left and right portions of the weight stack support member, respectively.

5. The exercise apparatus of any of claim 4, wherein the left and right hand pulleys each include an upper, claw end, and said means for securing the left and right hand pulleys to user-selectable portions of the frame include vertically spaced apart openings on the vertical, front members and horizontally spaced apart openings on said front, cross bar, said openings being dimensioned to receive and temporarily retain said claw ends.

6. The exercise apparatus of claim 4, wherein the left and right hand pulleys each include an upper, claw end, and said means for securing the left and right hand pulleys to user-selectable portions of the frame include vertically spaced apart openings on the vertical, front members and horizontally spaced apart openings on said front, cross bar and on said left and right, lower brace members, said openings being dimensioned to receive and temporarily retain said claw ends.

7. The exercise apparatus of claim 5, wherein said vertically spaced apart openings on the vertical, front members, said horizontally spaced apart openings on said front cross bar, and said vertically spaced apart openings on the stanchion, are labeled with indicia.

8. The exercise apparatus of claim 6, wherein said vertically spaced apart openings on the vertical, front members, said horizontally spaced apart openings on said front, cross bar and on said left and right, lower, brace members, and said vertically spaced apart openings on the stanchion, are labeled with indicia.

9. The exercise apparatus of claim 8, wherein the vertically spaced apart indicia on the stanchion are numerals arranged in numerical sequence and the horizontally spaced apart indicia on said front, cross bar and on said left and right, lower brace members, are letters arranged in alphabetical sequence.

10. The exercise apparatus of claim 4, wherein the left and right hand pulleys each include an upper, claw end, and said means for securing the left and right hand pulleys to user-selectable portions of the frame include vertically spaced apart chain links attached to one or more of said left and right, vertical, front members and said left and right, vertical ream members and/or horizontally spaced apart chain links attached to said top, cross bar and/or to said left and right base members, said chain links being dimensioned to receive and temporarily retain said claw ends.

11. The exercise apparatus of claim 10, wherein said chain links are labeled in numeral order with numerical indicia and/or in alphabetical order with alphabetical indicia.

12. The exercise apparatus of claim 11, wherein the frame, weight plates and cables are comprised of steel.

13. An exercise apparatus, comprising:

a frame, said frame including left and right, rectangular loops of cylindrical, tubular material with four rounded corners, said loops being laterally spaced-apart and of equal size, said loops being oriented at an angle θ of 70° to 130° with respect to each other, and each said loop including a horizontal top member and a horizontal bottom member, an outer, vertical member and an inner vertical member, wherein said rounded corners of each loop include an upper, outer corner that joins said top member to said outer vertical member, a lower, outer corner that joins said outer vertical member to said bottom member, an upper, inner corner that joins said top member to said inner vertical member, and a lower, inner corner that joins said inner, vertical member to said bottom member; and a guide rail that extends radially outward from a peripheral surface of each loop;

means for maintaining the positions of said loops fixed with respect to each other;

horizontal, left and right, lower weight stack mounting plates, each said plate being attached to, and extending rearwardly from, said bottom members of said left and right loops, respectively;

horizontal, left and right, upper weight stack mounting plates, each said plate being attached to, and extending rearwardly from, said left and right top members, respectively;

left and right vertical stanchions, said stanchions having a lower end attached to said left and right, lower weight stack mounting plates, and an upper end attached to said left and right, upper weight stack mounting plates, respectively, each said stanchion having a plurality of vertically spaced apart openings or chain links;

a pulley carriage mounted to each of said left and right stanchions for vertical travel thereon, said carriage carrying a carriage pulley disposed for rotation about a horizontal axis;

a carriage pin insertable into any one of said openings or chain links in said stanchion to thereby fix the position of said carriage on said stanchion;

left and right weight stack assemblies disposed over said left and right, lower weight stack plates, respectively, each weight stack assembly including a weight pin;

a pair of laterally spaced-apart, vertical guide rods that extend from a lower weight stack mounting plate up to an upper weight stack mounting plate;

a plurality of horizontal, vertically-stacked, weight plates mounted for vertical, sliding movement along the guide rods, each weight plate having a pair of laterally spaced apart, vertically-directed openings through which said guide rods are inserted, a vertically-directed, central opening, and a horizontally-directed opening; and a vertical weight post inserted through said central opening of each of said weight plates, said post having vertically spaced-apart openings, such that insertion of said weight pin through said horizontally-directed opening of any of said weight plates may be further inserted into any of said openings of said post to thereby select a desired number of weight plates for attachment to the weight post;

left and right swivel pulleys mounted to upper, left and right portions of the frame, respectively;

left and right weight turnbuckles attached to upper end portions of said left and right weight posts;

left and right, slotted collar assemblies, said collar assemblies being mounted on said left and right loops, respectively, for sliding movement thereon, wherein each collar assembly includes a collar, said collar having an apertured ear and an internal diameter slightly larger than the external diameter of the cylindrical, tubular material of said loops, said collar having a peripheral, slotted cutout that extends through the full longitudinal extent of the collar and parallel to a longitudinal axis through the collar, said cutout being dimensioned to receive and slide along said rail; and means for temporarily attaching said collar to a user-selectable location on a loop;

left and right hand pulleys pivotally suspended from an apertured ear of a collar of said left right collar assemblies, respectively;

left and right hand grips;

left and right, upper pulley means attached to said left and right, upper portions of said frame, respectively, said means including at least one pulley that is rotatable about a horizontal axis;

left and right cables, wherein said left cable has a first end attached to said left turnbuckle and extends thence upward, over and around said left upper pulley means, thence down, under and partially around the left carriage pulley, thence up, over and partially around the left swivel pulley, thence over and partially around the left hand pulley, thence to a second opposite end that is attached to the left hand grip; and said right cable has a first end attached to said right turnbuckle and extends thence upward, over and around said right, upper pulley means, thence down, under and partially around the right carriage pulley, thence up, over the right swivel pulley, thence over and around the right hand pulley, thence to a second, opposite end that is attached to the right hand grip.

14. The apparatus of claim 13, wherein the means to maintain the loops in fixed positions with respect to each other includes a horizontal, rear, top cross bar that joins rear, upper portions of said loops to each other;

a horizontal, front, top cross bar that joins front, upper portions of said loops to each other; and a horizontal, bottom cross bar that joins rear, lower portions of said loops to each other.

15. The apparatus of claim 14, wherein said left upper pulley means includes first and second, laterally spaced apart, left upper pulleys attached to the left, upper weight stack plate and disposed for rotation about horizontal axes; and said right upper pulley means includes first and second, laterally spaced apart, right upper pulleys attached to the right, upper weight stack plate and disposed for rotation about horizontal axes.

16. The apparatus of claim 15, wherein said left and right, upper pulley means each further include first and second guide rollers disposed adjacent to said first and second, left and right upper pulleys for retaining said left and right cables on said pulleys, respectively.

17. The apparatus of claim 16, wherein each loop has spaced apart openings or chain links, each collar has a radially-directed, pin aperture, and the means for temporarily attaching said collar to a user-selectable location on a loop is a collar pin, which collar pin includes a shaft portion and a head portion, said shaft portion being insertable through said radially-directed, aperture of the collar and into any one of the user-selectable openings or chain links of a loop.

18. The apparatus of claim 17, wherein said collar pin is permanently disposed within said collar aperture and further includes a spring circumposed about said shaft portion, which spring urges said shaft portion radially inward through said collar aperture and into any opening or chain link of a loop that is in registry with said collar aperture.

19. The apparatus of claim 18, wherein the frame further includes, for each lower weight stack mounting plate, a support brace that extends rearwardly from the bottom member of each loop to which it is attached to a first, rear portion of said plate, and a second, opposite, rear portion of each said plate is attached to the nearest end of the bottom cross bar.

20. The apparatus of claim 19, wherein the frame further for each upper weight stack mounting plate includes, for each upper weight stack mounting plate, a support brace that extends rearwardly from the top member of each loop to which it is attached to a first, rear portion of said plate, and a second, opposite, rear portion of each said plate is attached to the nearest end of the top cross bar.

21. The apparatus of claim 20, wherein said material is steel and the frame, weight plates and cables are comprised of steel.

22. An exercise apparatus, comprising:

a frame, said frame including left and right, rectangular loops of cylindrical, tubular material with four rounded corners, said loops being laterally spaced-apart and of equal size, said loops being oriented at an angle θ of 70° to 130° with respect to each other, and each said loop including a horizontal top member and a horizontal bottom member, an outer, vertical member and an inner vertical member, wherein said rounded corners of each loop include an upper, outer corner that joins said top member to said outer vertical member, a lower, outer corner that joins said outer vertical member to said bottom member, an upper, inner corner that joins said top member to said inner vertical member, and a lower, inner corner that joins said inner, vertical member to said bottom member; and a guide rail that extends radially outward from a peripheral surface of each loop;

means for maintaining the positions of said loops fixed with respect to each other;

horizontal, left and right, lower weight stack mounting plates, each said plate being attached to, and extending rearwardly from, said bottom members of said left and right loops, respectively;

horizontal, left and right, upper weight stack mounting plates, each said plate being attached to, and extending rearwardly from, said left and right top members, respectively;

left and right vertical stanchions, said stanchions having a lower end attached to said left and right, lower weight stack mounting plates, and an upper end attached to said left and right, upper weight stack mounting plates, respectively, each said stanchion having a plurality of vertically spaced apart openings;

a pulley carriage mounted to each of said left and right stanchions for vertical travel thereon, said carriage carrying a carriage pulley disposed for rotation about a horizontal axis;

a carriage pin insertable into any one of said openings in said stanchion to thereby fix the position of said carriage on said stanchion;

left and right weight stack assemblies disposed over said left and right, lower weight stack plates, respectively, each weight stack assembly including a weight pin;

a pair of laterally spaced-apart, vertical guide rods that extend from a lower weight stack mounting plate up to an upper weight stack mounting plate;

a plurality of horizontal, vertically-stacked, weight plates mounted for vertical, sliding movement along the guide rods, each weight plate having a pair of laterally spaced apart, vertically-directed openings through which said guide rods are inserted, a vertically-directed, central opening, and a horizontally-directed opening aligned with said central opening;

and a vertical weight post insertable through said central opening of each of said weight plates, said post having vertically spaced-apart openings, such that insertion of said weight pin through said horizontally-directed opening of any of said weight plates may be further inserted into any of said openings of said post to thereby select a desired number of weight plates for attachment to the weight post;

first and second, left and right swivel pulleys mounted to upper, left and right portions of the frame, respectively;

left and right weight stack pulleys attached to upper end portions of said left and right weight posts;

left and right, slotted collar assemblies, said collar assemblies being mounted on said left and right loops, respectively, for sliding movement thereon, wherein each collar assembly includes a collar, said collar having an apertured ear and an internal diameter slightly larger than the external diameter of the cylindrical, tubular material of said loops, said collar having a peripheral, slotted cutout that extends through the full longitudinal extent of the collar and parallel to a longitudinal axis through the collar, said cutout being dimensioned to receive and slide along said rail; and means for temporarily attaching said collar to a user-selectable location on a loop;

left and right hand pulleys pivotally suspended from an apertured ear of a collar of said left right collar assemblies, respectively;

first left and right hand grips;

second left and right hand grips, which grips include means for releasably attaching them to a cable;

left and right top pulleys attached to said frame and disposed for rotation about laterally spaced apart, horizontal axes;

left and right, upper pulley means attached to said left and right, upper portions of said frame, respectively, said means including at least one pulley that is rotatable about a horizontal axis;

left and right cables, wherein said left cable has a first end attached to said first left hand grip; extends thence to, over and around said left, top pulley; thence over and around said first, left swivel pulley; thence down to, underneath and around said left weight stack pulley; thence up to, over and around said left, upper pulley means; thence down to, underneath and around the left carriage pulley; thence up to, over and around said second, left swivel pulley; thence to, over and around said left hand pulley; and thence to a second, opposite end that is releasably attached to the second, left hand grip; and said right cable has a first end attached to said first, right hand grip; extends thence to, over and around said right, top pulley; thence over and around a first, right swivel pulley; thence down to, underneath and around said right weight stack pulley; thence up to, over and around said right, upper pulley means; thence down to, underneath and around the right carriage pulley; thence up to, over and around said second, right swivel pulley; thence to, over and around said right hand pulley; and thence to a second, opposite end that is releasably attached to the second, left hand grip.

23. The apparatus of claim 22, wherein the means to maintain the loops in fixed positions with respect to each other includes left and right, vertical spacers attached to said left and right, upper weight stack mounting plates;

a horizontal, rear, top cross bar that joins upper ends of said left and right spacers;

a horizontal, front, top cross bar that joins front, upper portions of said loops to each other; and a horizontal, bottom cross bar that joins rear, lower portions of said loops to each other.

24. The apparatus of claim 23, wherein said left upper pulley means includes first and second, laterally spaced apart, left upper pulleys attached to the left, upper weight stack plate and disposed for rotation about horizontal axes; and said right upper pulley means includes first and second, laterally spaced apart, right upper pulleys attached to the right, upper weight stack plate and disposed for rotation about horizontal axes.

25. The apparatus of claim 15, wherein said left and right, upper pulley means each further include first and second guide rollers disposed adjacent to said first and second, left and right upper pulleys for retaining said left and right cables on said pulleys, respectively.

26. The apparatus of claim 15, wherein each loop has spaced apart openings or chain links, each collar has a radially-directed, pin aperture, and the means for temporarily attaching said collar to a user-selectable location on a loop is a collar pin, which collar pin includes a shaft portion and a head portion, said shaft portion being insertable through said radially-directed, aperture of the collar and into any one of the user-selectable openings or chain links of a loop.

27. The apparatus of claim 26, wherein said collar pin is permanently disposed within said collar aperture and further includes a spring circumposed about said shaft portion, which spring urges said shaft portion radially inward through said collar aperture and into any opening or chain link of a loop that is in registry with said collar aperture.

28. The apparatus of claim 27, wherein the first hand grips are heavier than the second hand grips.

29. The apparatus of claim 28, wherein the frame further includes, for each lower weight stack mounting plate, a support brace that extends rearwardly from the bottom member of each loop to which it is attached.

30. The apparatus of claim 23, wherein said frame, weight plates and cables are comprised of steel.

* * * * *

UNITED STATES PATENT AND TRADEMARK OFFICE

CERTIFICATE OF CORRECTION

PATENT NO. : 8,727,952 B1
APPLICATION NO. : 13/385102
DATED : May 20, 2014
INVENTOR(S) : John T. Carle It is certified that error appears in the above-identified patent and that said Letters Patent is hereby corrected as shown below:

On the Title Page, below "Primary Examiner -- Jerome W Donnelly," add -- Attorney, Agent, or Firm -- Brian J. Coyne.

Signed and Sealed this
Twenty-ninth Day of July, 2014

Michelle K. Lee

Michelle K. Lee
*Deputy Director of the United States Patent and Trademark Office*